United States Patent [19]

Fricano

[11] Patent Number: 5,050,944

[45] Date of Patent: Sep. 24, 1991

[54] OVER OR UNDER FLIPPER DOOR MOUNTING

[75] Inventor: Nicholas J. Fricano, Grand Haven, Mich.

[73] Assignee: Haworth, Inc., Holland, Mich.

[21] Appl. No.: 629,832

[22] Filed: Dec. 19, 1990

[51] Int. Cl.[5] ..... A47B 88/00

[52] U.S. Cl. ..... 312/323; 16/361; 49/257; 49/258; 49/260

[58] Field of Search ..... 312/322, 323, 331; 16/361, 364; 49/197, 254, 257, 258, 260

[56] References Cited

U.S. PATENT DOCUMENTS

| | | | |
|---|---|---|---|
| 3,771,847 | 11/1973 | Aylworth | 312/321.5 X |
| 4,375,907 | 3/1983 | Vander Kooi et al. | 312/323 X |
| 4,516,813 | 5/1985 | Sekerich | 312/323 |
| 4,591,214 | 5/1986 | Reuter et al. | 312/322 X |
| 4,615,570 | 10/1986 | Goodman | 312/331 X |

*Primary Examiner*—Kenneth J. Dorner
*Assistant Examiner*—Brian K. Green
*Attorney, Agent, or Firm*—Flynn, Thiel, Boutell & Tanis

[57] ABSTRACT

A storage cabinet having a front access opening, and a door for closing the opening, which door hinges upwardly into an open position and then is movable linearly rearwardly of the cabinet for storage in a position wherein the door and cabinet top wall are disposed adjacent and substantially directly over one another. A support arrangement includes a pair of gear/rack mechanisms which couple the door to the cabinet side walls to provide for opening and closing movement of the door. The mechanisms, which include elongate rack members fixed to the cabinet side walls, secure the door in one of two different positions to enable the door to be disposed for cooperation with the top wall to permit storage of the door either above or below the top wall depending on the selected position of the rack members. The top wall is fixedly but releasably secured to the rack members for disposition in one of two different elevations depending upon the selected position of the rack members.

13 Claims, 3 Drawing Sheets

OVER OR UNDER FLIPPER DOOR MOUNTING

FIELD OF THE INVENTION

This invention relates to a cabinet having an openable door and, in particular, to an improved support arrangement which enables the door to be hinged upwardly about a generally horizontal axis into an open position and then moved generally linearly into a storage position, which support mechanism is adaptable for permitting the door to be stored either over or under the cabinet top wall.

BACKGROUND OF THE INVENTION

Storage cabinets are conventionally utilized in offices wherein a boxlike cabinet housing is provided with a front opening, and a door is positionable over the opening for closing of the cabinet. The door is conventionally mounted on the cabinet by a support which permits the door to be swung upwardly about an axis disposed in the vicinity of its upper edge into an open position, and then moved generally linearly into a storage position wherein the door is disposed directly above and in substantially parallel relationship to the cabinet top wall.

In one conventional cabinet known as a "flipper" door cabinet, the door is supported such that it hinges upwardly into an open position and then moves linearly rearwardly so as to be stored and supported directly above the cabinet top wall when the door is in a fully opened position. Various hinge-type support mechanisms are provided for connecting the door to the cabinet housing, which support mechanisms often employ elongated hinge-type telescopic ball slide mechanisms.

As a variation, other known cabinets move the door horizontally linearly rearwardly into a storage position wherein the door is supported directly under the cabinet top wall when the door is in the fully opened position. Again, the door is connected to the cabinet housing using hinge-type support mechanisms which may assume many different conventional types, such as hinge-type telescopic ball slide mechanisms or gear-rack mechanisms.

The known cabinets, as briefly described above, generally provide for storage of the door solely either above or below the cabinet top wall, and thus manufacturers must provide two significantly different cabinets depending upon whether the customer desires either an over or under door-storage cabinet. This increases the manufacturing costs and complexities, and more importantly restricts the flexibility and adaptability of the cabinet by the customer with respect to modifications or adaptations required for most efficient usage. That is, if a customer determines that a below door-storage cabinet is not suitable for a particular condition due to changing needs, then the below door-storage cabinet must be removed and replaced by an over door-storage cabinet. This often requires that the customer purchase a second cabinet, or in the alternative the customer continues to use the original cabinet even though it is not fully suited for current requirements.

Accordingly, the present invention relates to improvements in cabinets of the above-described type, which cabinet can be readily adapted either during initial assembly or by subsequent modification so as to permit adjustment of the top wall between two different positions and corresponding adjustment of the hingetype support mechanism between two different positions so that the same cabinet arrangement can be readily positioned to perform either as an over door-storage or an under door-storage cabinet. That is, the door when in its fully opened position can be stored directly above the top wall when the top wall is in one of two selectable positions, and alternatively the door can be stored directly under the top wall when the latter is mounted in its other predetermined position.

More specifically, in the improved cabinet of the present invention, the side walls have recesses formed therein adjacent upper edges thereof and in communication with inner side surfaces. The recesses fixedly but removably receive inserts which are vertically oriented in two different positions merely by vertically rotatably positioning the inserts relative to the side walls and then securing the inserts within the respective recesses. Each insert mounts thereon an elongate gear rack which extends in the front-to-back direction of the side wall, and which is oriented either upwardly or downwardly, depending upon the selected position of the insert. The cabinet top wall extends between the side walls and mounts to the opposed inserts, with the top wall being disposed either substantially flush with the upper edges of the side walls or spaced downwardly a small extent therefrom, depending upon the vertical orientation of the inserts. A door is positioned in front of the cabinet housing and extends horizontally between the side walls, with the door mounting thereon a gear arrangement adjacent the upper edge thereof. The gear arrangement can be rotatably mounted on the door in one of two predetermined vertically-spaced positions depending upon the vertical orientation of the inserts. The gear arrangement includes a shaft which is rotatably supported on and extends lengthwise of the door and has gear wheels secured thereto, which gear wheels are maintained in meshing engagement with the gear racks associated with the inserts. Depending upon the selected vertical orientation of the inserts and the corresponding position of the top wall and of the gear arrangement, the door will move into a open storage position disposed below the top wall when the latter is in an upper position substantially flush with the upper edges of the side walls, and will move into a horizontal storage position disposed above the top wall when the inserts are oriented such that the top wall is mounted in downwardly spaced relationship from the upper edges of the side walls.

With the improved arrangement of the present invention, the same cabinet components can be utilized to permit storage of the door either above or below the cabinet top wall, and in fact the cabinet can be readily modified to permit storage of the door either above or below the top wall merely by minor structural modifications which permit such adaptation to be made in a simple and time efficient manner.

Other objects and purposes of the present invention will be apparent to persons familiar with assemblies of this general type upon reading the following specification and inspecting the accompanying drawings.

Figure 1:
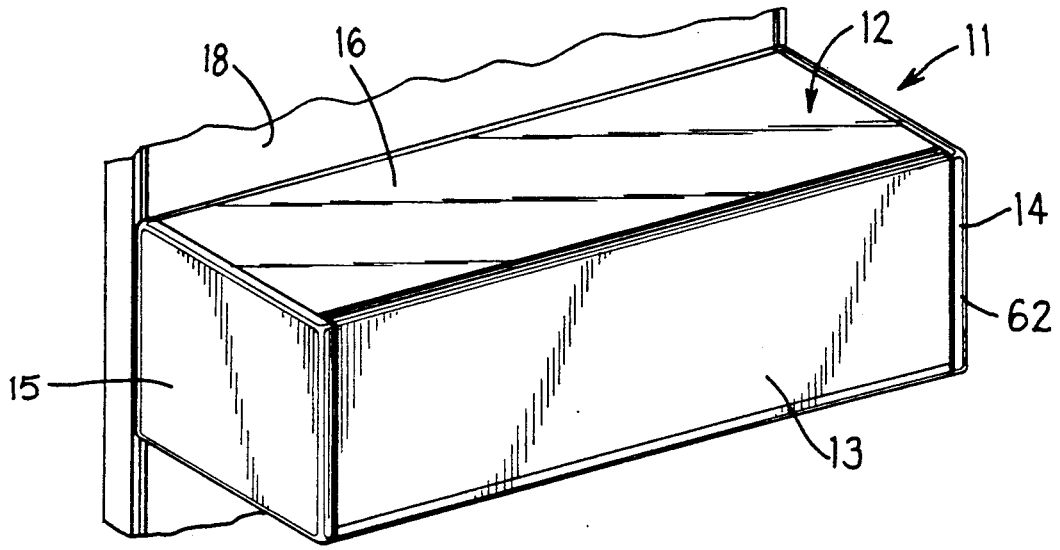
FIG. 1 a perspective view illustrating the cabinet of the present invention mounted in a conventional manner upright wall panel.

Certain terminology will be used in the following description for convenience in reference only, and will not be limiting. For example, the words "upwardly", "downwardly", "rightwardly" and "leftwardly" will refer to directions in the drawings to which reference is made. The word "upwardly" will also be used in reference to the normal opening direction of the door. The word "front" will be used with reference to the side of the cabinet on which the door is positioned, and the word "rear" will be used in reference to the other side, namely the side which attaches to the wall panel. The words "inwardly" and "outwardly" will refer to directions toward and away from, respectively, the geometric center of the cabinet structure and designated parts thereof. Said terminology will include the words specifically mentioned, derivatives thereof, and words of similar import.

DETAILED DESCRIPTION

FIG. 1 illustrates a flipper-door cabinet 11 which includes a main cabinet body or housing 12 having an opening on the front side thereof, which opening is closable by a door 13. The cabinet body 11 is of a box-like construction which defines an interior storage compartment and includes generally parallel and vertically extending side walls 14 and 15 which are rigidly joined together by generally parallel and horizontally extending top and bottom walls 16 and 17, respectively. The rear of the panel can be closed by a rear wall but, in the illustrated embodiment, the rear of the cabinet is closed due to the cabinet being mounted in a conventional manner on an upright wall panel 18. The rear edges of the side walls 14 and 15, in a conventional manner, are provided with mounting clips which engage slotted uprights associated with the wall panel to permit the cabinet to be mounted on and cantilevered from the wall panel, such being conventional and well known. Other conventional mounting techniques, can also be utilized.

Figure 2:
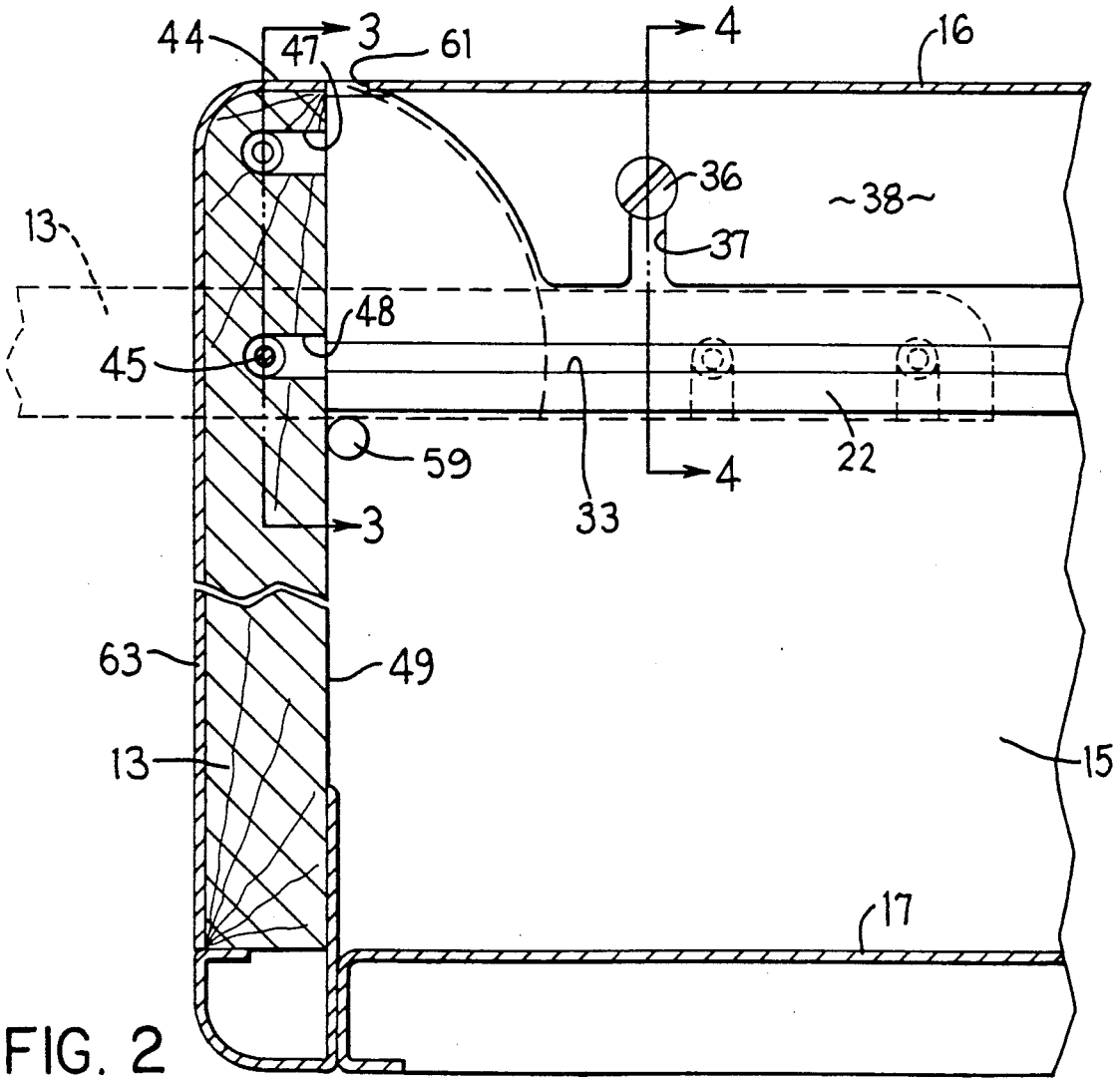
FIG. 2 is an enlarged fragmentary sectional view taken in the front-to-back direction of the cabinet, and showing the cabinet in a first modification wherein the door stores beneath the cabinet top wall.
Figure 5:
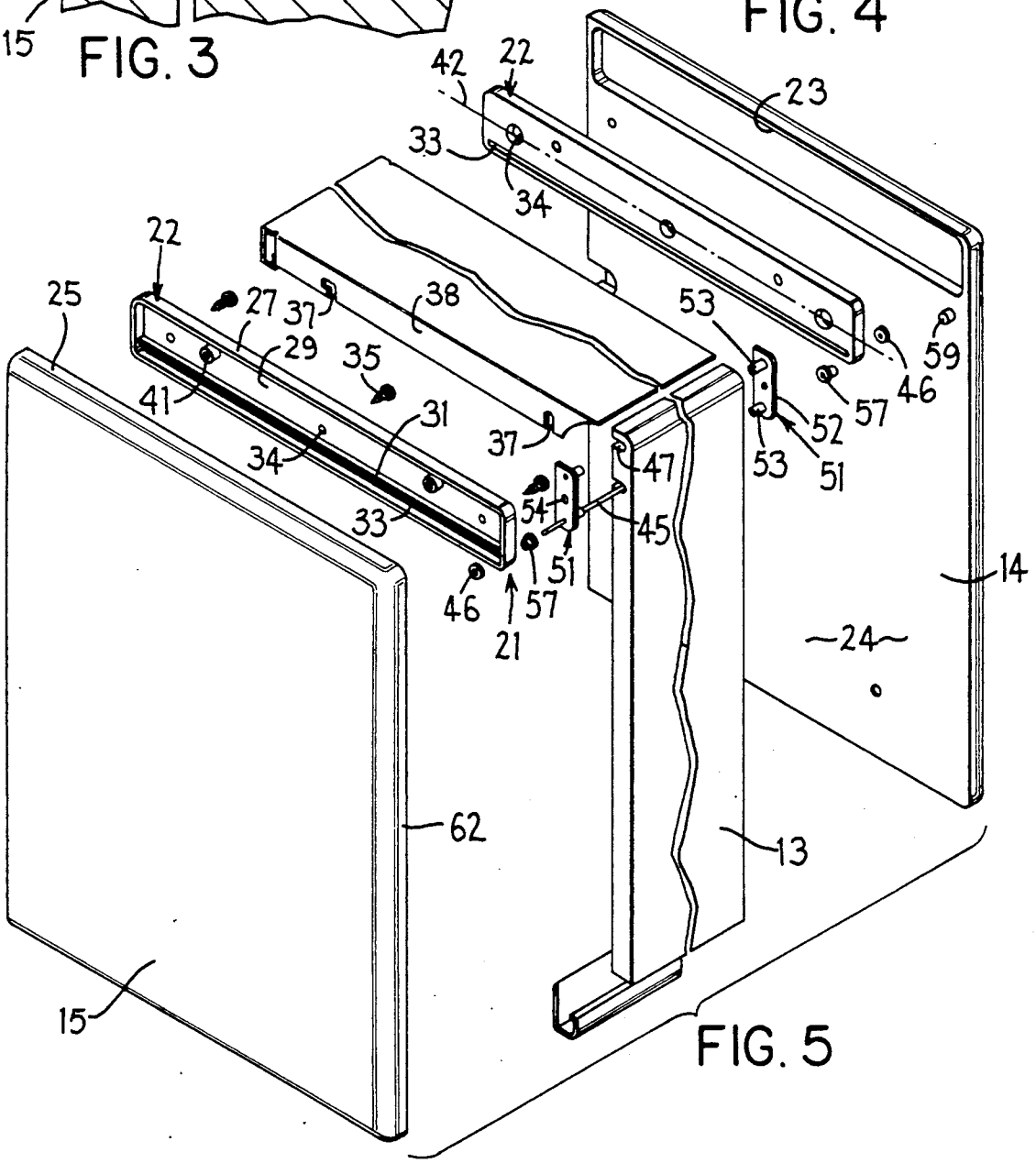
FIG. 5 is an exploded perspective view illustrating the components which make up the cabinet illustrated by FIGS. 2-4.
Figure 6:
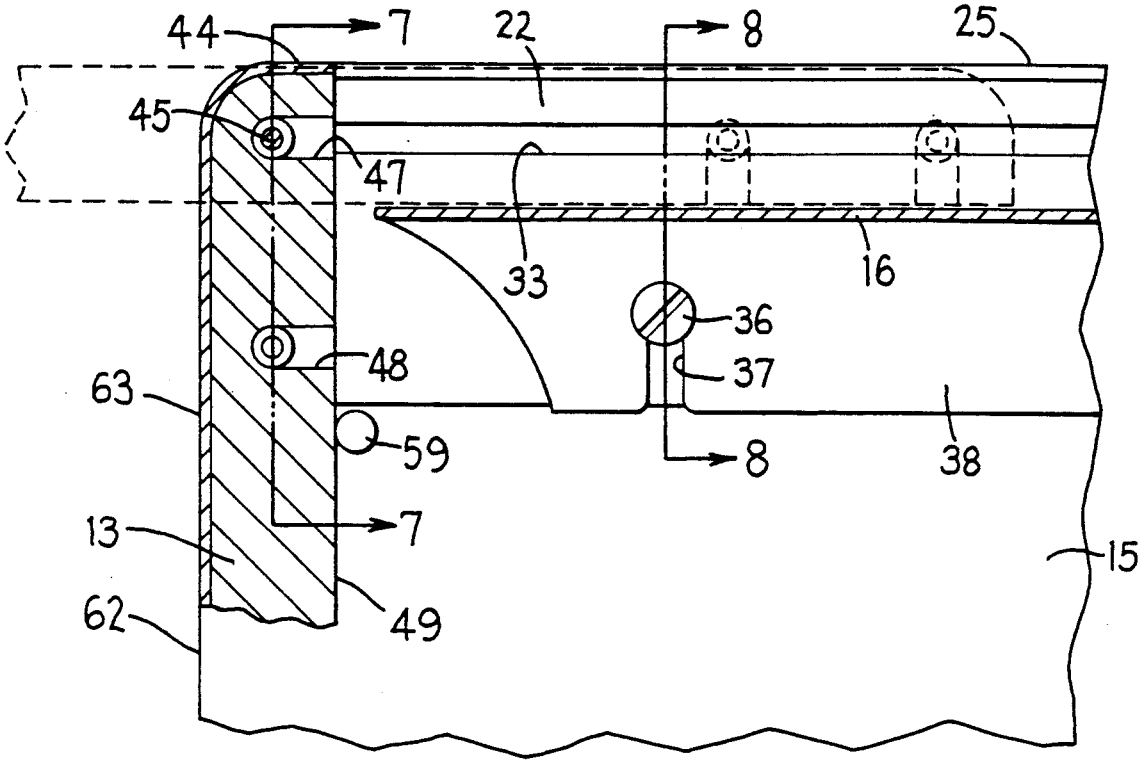
FIG. 6 is a view similar to FIG. 2 but illustrating a second modification of the cabinet wherein the door above the cabinet top wall.

To permit movement of the door 13 between closed and open positions, the door 13 is connected to the cabinet body 12 by a gear/rack support arrangement 21 (FIG. 5). This support arrangement 21 permits the top wall 16 and door 13 to be structurally and functionally related in two different orientations, one of which enables the door 13 to be opened into a position interiorly of the cabinet directly below the top wall substantially as illustrated by FIG. 2, and the other of which enables the door 13 to be opened into a position wherein it is disposed directly upon the top wall 16 as illustrated by FIG. 6. These two alternate orientations are explained in greater detail below.

Referring to FIGS. 2-5, the gear/rack support arrangement 21 includes a pair of identical elongate rack members 22 formed as inserts and adapted to be disposed within shallow recesses 23 formed adjacent the inner upper sides of the side walls 14 and 15. The recess 23 opens inwardly from the inner surface 24 of the side wall and projects partially through the thickness thereof, and in addition extends horizontally in the front-to-back dimension throughout a majority of the depth of the side wall, the recess being spaced downwardly only a small extent from the side wall top edge 25.

The insert 22 is defined by a generally vertically extending base wall 26 having a generally rectangular configuration, which base wall has a ringlike flange secured around the periphery so as to project sidewardly thereof. This ringlike flange includes top and bottom flanges 27 and 28 which extend horizontally in generally parallel relationship along the upper and lower edges of the base wall 26, and this ringlike flange cooperates with the base wall to define a recess 29.

Insert 22 has a further flange 31 which projects transversely from the base wall 26 into the recess 29. This flange 31 also extends horizontally generally throughout the length of the insert so as to be disposed between and in generally parallel relationship to the top and bottom flanges 27 and 28. Flange 31 has a gear rack 32 formed along one side thereof and extending generally throughout the complete length of the flange, which gear rack 32 is disposed so as to face the edge flange 28. A horizontally elongate slot 33 is formed through the base wall 26 so as to open directly into the vertical region disposed between the rack 32 and the edge flange 28.

Figure 4:
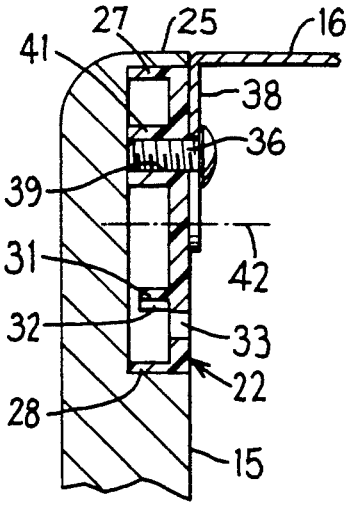

As illustrated by FIGS. 4 and 5, the flange 31 and gear rack 32 defined thereon are spaced (i.e., vertically offset) from a horizontal plane 42 which passes through the vertical midpoint of the insert, whereby the flange 31 is disposed significantly more closely adjacent the edge flange 28 than the edge flange 27. In fact, the vertical spacing between the rack 32 and the edge flange 27 is more than twice the vertical spacing between the rack 32 and the edge flange 28.

Figure 3:
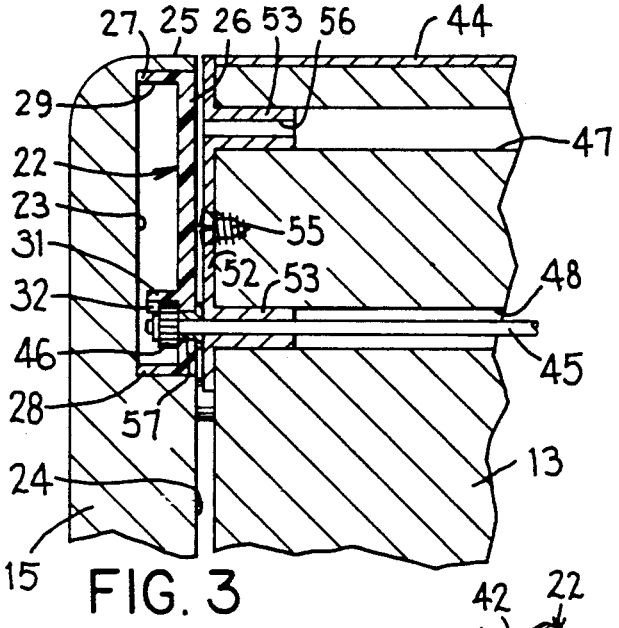
FIGS. 3 and 4 are fragmentary sectional views taken substantially along lines 3—3 and 4—4, respectively, in FIG. 2.

The insert 22 is dimensioned so as to snugly fit within and substantially totally occupy the recess 23, with the back or inner surface of the base wall 26 being substantially flush with the inner surface 24 of the side wall as illustrated by FIGS. 3 and 4. To releasably but fixedly secure the insert 22 to the respective side wall, the base wall 26 has a series of small openings 34 extending therethrough for accommodating therein fasteners (specifically screws) 35 which penetrate the respective side wall for securing the insert thereto. The openings 34 are disposed with their centerlines generally on the central horizontal plane 42. This hence permits the insert 22 to be vertically rotated 180° so as to be reversely mounted within the side wall recess 23 and then again secured thereto by threading the screws 35 into the same openings in the side wall.

To fixedly join the top wall 16 between the side walls 14 and 15, the top wall 16 is provided with a downwardly projecting side flange 38 at each end edge thereof, which flange 38 has a pair of slots 37 opening upwardly from the lower edge thereof. The flange 38 is adapted to be positioned so as to directly overlie the adjacent surface of the insert base wall 26, and screws 36 are extended through the slots 37 into threaded bores 39 defined within hubs 41 which are fixedly secured to the insert base wall 26. These hubs 41 are also vertically spaced relative to the central horizontal plane 42, and preferably are disposed on the opposite side of plane 42 from the gear rack 32.

The insert 22, including the flange 31, rack 32 and hubs 41, are preferably formed as a rigid and integral one-piece structure, such as by being molded of a hard and relatively strong plastic material.

The gear/rack support arrangement 21 also includes a horizontally elongate shaft 45 having gears 46 nonrotatably secured adjacent opposite ends thereof. This shaft 45 is adapted to be rotatably supported on the door 13 adjacent the upper edge 44 thereof, with the shaft 45 extending horizontally throughout the complete width of the door and projecting slightly outwardly beyond opposite end edges thereof for mounting thereon the gears 46. To accommodate the shaft 45, the door 13 has a pair of horizontally elongated grooves 47 and 48 extending across the entire width of the door. These grooves 47 and 48 each open inwardly from the inner surface 49 of the door. The groove 47 is spaced vertically downwardly a small distance from the upper door edge 44, and the groove 48 in turn is spaced downwardly a small vertical extent from the groove 47 but projects in parallel relationship therewith.

A bearing member 51 is mounted on each side edge of the door 13 for cooperation with the grooves 47 and 48. This bearing member 51 includes a generally vertically extending spanner plate 52 which directly overlies or is recessed into the side edge of the door, and fixedly mounts thereon a pair of parallel and horizontally projecting tubular hubs 53 which project into the adjacent ends of the grooves 47 and 48. The spanner plate 52 has an opening 54 therethrough for accommodating a fastener such as a screw 55 to permit fixed securement of the bearing member to the edge of the door.

Each of the hubs 53 has an opening 56 extending horizontally therethrough for rotatably supporting the shaft 45. This shaft 45 projects through a selected one of the hubs 53 and thence through the slot 33 formed in the insert 22 for positioning the gear 46 for engagement with the rack 32. A flanged sleevelike bushing 57 is rotatably supported on the shaft 45 just inboard of the gear 46, whereby the bushing 57 not only rotatably supports the shaft 45, but also projects through the slot 33 and is rotatably supported on the bottom wall defining the slot. The bushing 57 has an enlarged radial flange which projects between the spanner plate 52 and the insert base wall 26 so as to effectively function as a spacer for centrally positioning the door and preventing interference thereof with the side walls.

Each side wall 14 and 15 also has a stop 59 fixed to the inner surface 24 thereof and projecting outwardly through a small extent. This stop 59 is disposed closely adjacent the front edge of the respective side wall, and substantially directly under the forward end of the insert-receiving recess 23.

With the cabinet 11 of this invention, the top and bottom walls 16 and 17, respectively, are of lesser depth than the side walls 14 and 15, and in fact the front edge 61 of the top wall is disposed slightly rearwardly from the inner surface of the door as illustrated by FIG. 2 so as to provide sufficient swinging clearance for the door 13. Due to the lesser depth of the top and bottom walls, the vertically-extending front edges 62 of the side walls 14 and 15 are spaced forwardly from the front edge of the bottom wall by a horizontal extent which at least approximately corresponds to the thickness of the door 13. Hence, the door 13 has a horizontal length which enables it to effectively fit between the side walls 14 and 15 and, when disposed in a closed position, the front vertical surface 63 of the door is disposed in substantially the same plane as the vertically extending front edges 62 of the side walls.

The assembly and operation of the cabinet 11 for permitting storage of the door inside the cabinet (i.e., below the top wall) will now be explained with reference to FIGS. 2–4.

The inserts 22 are positioned within the side wall recesses 23 such that the gear racks 32 are lowermost and face downwardly, with the inserts being fixed to the side walls by screws 35. The gear shaft 45 is positioned so as to be rotatably supported by the lower hubs 53, namely those hubs which project into the lower groove 48 so that the shaft 45 extends therethrough. The outer ends of the shaft 45 where they project beyond the side edges of the door project through the horizontal guide slots 33 whereby the gears 46, as nonrotatably secured to the shaft 45, engage the downwardly facing gear racks 32. The bushings 57, as confined between the bearing spanner plates 52 and the gears 46, result in the sleeve portions of the bushings being rotatably and rather closely confined within the slots 33 so as to maintain the gears 46 in engagement with the respective racks 32. At the same time, the top wall 16 is assembled by means of the screws 36 projecting through the slots 37 in flanges 38 for engagement within the threaded hubs 41. Since the inserts 22 are mounted within the side wall recesses so that the gear rack 32 are disposed lowermost, this results in the hubs 41 being disposed uppermost, and results in the top wall 16 being disposed so that its upper surface is substantially flush with the upper edges of the side walls substantially as illustrated by FIGS. 3 and 4. Further, the upper edge of the door 13 is also substantially flush with the top surface of the top wall, and the door effectively nests between the front portions of the side walls 14 and 15, as illustrated by FIG. 1, so that the front surface of the door when the door is in a closed position is substantially flush with the front vertical surfaces of the side walls. With the door in the closed position as illustrated by FIG. 2, the front edge 61 of the top wall is spaced rearwardly a small distance from the door to provide a small clearance gap therebetween to facilitate inward swinging of the door during opening movement thereof, such as indicated by the dash-line in FIG. 2.

When the door is opened, it is manually gripped adjacent the lower free edge thereof and then swung upwardly (clockwise in FIG. 2) about a pivot axis defined by the rotational axis of shaft 45 until the door assumes a substantially horizontal position and projects generally outwardly away from the cabinet, following which the door is then slid horizontally inwardly into the cabinet, substantially as indicated by dotted lines in FIG. 2, so as to be stored substantially interiorly of the cabinet below the top wall 16.

During movement of the door 13 horizontally inwardly of the cabinet, the gears 46 remain rollingly engaged with the gear racks 32 and, due to the fact that the gears 46 are nonrotatably connected together by the shaft 45, this ensures that the opposite sides of the door move inwardly in synchronization with one another so as to prevent skewing or binding as the door is moved inwardly (or conversely outwardly) of the cabinet. Once the door has been moved inwardly of the cabinet into an open storage position, the door adjacent opposite sides thereof, and in the vicinity of the free edge thereof, rests on the stops 59 so as to prevent the door from falling downwardly. With the door in this open stored position, the interior of the cabinet is accessable and usable for storage up to a height just below the bottom surface of the door.

When the door is to be returned to the closed position from the open stored position illustrated by dotted lines in FIG. 2, then the reverse sequence of movements occurs. That is, the door is initially horizontally pulled outwardly away from the cabinet and, when fully withdrawn, is swung downwardly (counterclockwise in FIG. 2) to return to its fully closed position.

Figure 7:
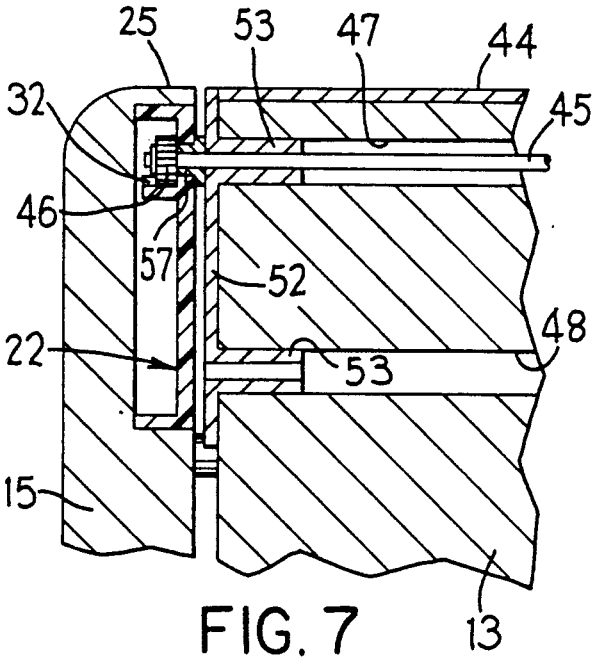
FIGS. 7 and 8 are fragmentary sectional views taken substantially along lines 7—7 and 8—8, respectively, of FIG. 6.
Figure 8:
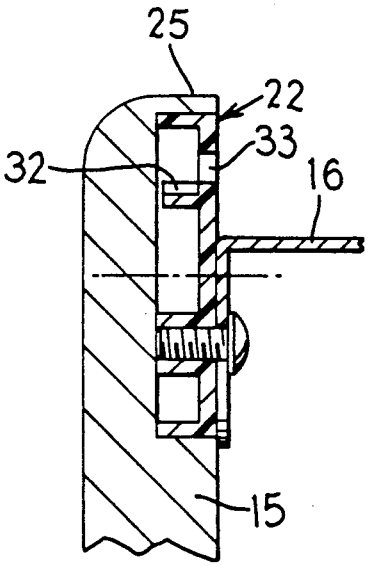

If it is desired to use the cabinet in a variation wherein the door is stored over the top wall rather than interiorly of the cabinet, then the overall cabinet assembly can be either initially assembled, or reassembled from the configuration shown in FIGS. 2–4, so as to assume the configuration shown by FIGS. 6–8. For example, during initial assembly the shaft 45 is positioned within the upper groove 47 so as to be supported by the upper hubs 53, and the inserts 22 are oriented so that the gear racks 32 face upwardly, whereupon the hubs 41 are thus disposed downwardly therefrom. The inserts 22 are inserted into the side wall recesses 23 with the gear racks 32 facing upwardly and are secured to the side walls by the screws 35. The door is suspended from the inserts due to the bushings 57 being guidably engaged within the grooves 33, and the gears 46 being engaged with the gear racks 32. The top wall 16 is secured to the inserts 22 due to the screws 36 extending through slots 37 for engagement within the threaded hubs 41, thereby resulting in the upper surface of top wall 16 being disposed downwardly relative to the upper edges 25 of the side walls, substantially as illustrated by FIG. 8. The downward spacing of the top wall 16 from the upper edges 25 is a vertical extent which substantially corresponds to the thickness of the door 13.

When in the closed position, the upper edge 44 of the door is still substantially horizontally coplanar with the upper edges 25 of the side walls, but the top wall 16 is spaced downwardly therefrom, substantially as illustrated by FIG. 6. When opening of the door is desired, the door is swung outwardly and upwardly (clockwise in FIG. 6) about a hinge axis defined by the shaft 45 until the door projects substantially horizontally outwardly away from the cabinet, following which the door is generally linearly moved horizontally rearwardly, as indicated by dotted lines in FIG. 6, so as to be positioned substantially directly over and in fact supported on the top wall 16. During this inward linear movement of the door over the top wall, the engagement of gears 46 with racks 32 prevents skewing or tilting of the door.

When closing of the door from the dotted line position of FIG. 6 is desired, then a generally reverse sequence of door movements is performed.

If the cabinet is initially assembled for under storage of the door (FIGS. 2–4) and it is desired to reassemble it for over door storage (FIGS. 6–8) or vice versa, then the top wall 16 and the door 13 and inserts 22 (i.e. rack members) are disconnected from the side walls 14, 15 and from one another, then inserts 22 are vertically rotated 180° so that the gear racks 32 face in the opposite direction, the gears 46 and bushings 57 are removed from the shaft 45 and the shaft removed from one of the grooves 47 and 48 and inserted into the other of the grooves 47 and 48 and the gears and bushings reassembled thereon, the door and inserts are reassembled and the inserts reinserted into the side wall recesses and fixedly secured by the securing screws, followed by securement of the top wall to the inserts. Hence, the cabinet can be readily disassembled, rearranged and reassembled so as to vary the cabinet between under and over door storage positions without requiring any additional parts or components, and without requiring any complex assembly techniques or tools.

While the illustrated embodiment shows the gear rack 32 spaced from the edge flange 28, it will be appreciated that the gear rack can be formed on the flange 28 and face in the opposite vertical direction.

In addition, the illustrated embodiment shows the door 13 constructed of wood and hence the grooves 47 and 48 extend across the full width thereof. However, the door 13 could also be formed from thin metal plate, in which case the edges of the door would be suitably formed (such as roll formed flanges) in a conventional manner so as to protrude transversely rearwardly from the door front wall. In such case, the grooves 47 and 48 would be formed in aligned relation in the opposed side edge flanges of the door so as to permit extension of the shaft 45 therebetween.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a storage cabinet having a housing defined by generally parallel horizontally-extending top and bottom walls rigidly joined together by generally parallel vertically-extending side walls, the housing defining therein an interior storage compartment and having an opening in a front side thereof for access to said storage compartment, a door positionable adjacent the front side of said housing when in a closed position for closing off said access opening, and a support arrangement including a pair of gear/rack support mechanisms connected between said door and said side walls for permitting the door to be both swingably moved into an open position wherein the door extends generally horizontally in close proximity to the elevation of the top wall and linearly into a storage position wherein the door and top wall are positioned closely adjacent and substantially directly over one another, the improvement in said support arrangement comprising:

said gear/rack mechanism including a horizontally elongate rack member fixedly but releasably secured to a respective said side wall adjacent an inner side thereof and in the vicinity of an upper edge thereof, said rack member defining thereon a horizontally elongated toothed rack which extends over a significant extent in the front-to-back direction of the cabinet;

said rack member and said side wall having cooperating means which permit the rack member to be fixedly but releasably mounted on the side wall in either a first position wherein the toothed rack is disposed in a first functional condition or a second position wherein the tooth rack is disposed in a second functional condition which is different from said first functional condition;

a gear disposed for meshing and rolling engagement with each toothed rack;

mounting means associated with said door in the vicinity of each upper corner thereof for rotatably mounting a said gear thereon so that a pair of said gears are rotatably mounted on said door for rotation about a generally horizontal axis which extends lengthwise of the door in the vicinity of the upper edge thereof with the gears being positioned outwardly from but adjacent opposite side edges of the door;

said door and said mounting means including cooperating means for mounting the gears and the rotational axis thereof on said door at either first or second locations which are both disposed adjacent the upper edge of the door but which are vertically spaced a predetermined vertical distance apart when the door is in said closed position;

said gears being mounted in said first location and maintained in running meshing engagement with the toothed racks when the rack members are mounted in said first position, and said gears being mounted on said door in said second location and maintained in running meshing engagement with the toothed racks when the rack members are mounted in said second position; and securing means for fixedly but releasably securing said top wall relative to said side walls at either of first and second elevations which are vertically spaced a predetermined distance apart;

said door being movable into a storage position disposed directly above the top wall when said top wall is in said first elevation and said rack members are mounted in said first position, and said door being movable into a storage position directly below the top wall when said top wall is disposed in said second elevation and said rack members are in said second position.

2. A cabinet according to claim 1, wherein the rack members are disposed in a first upright vertical orientation for securement to the respective side wall for defining said first position, and the rack members are vertically rotated 180° relative to the side wall from said first position so as to define said second position, said toothed racks being vertically oriented so as to face in opposite vertical directions when the rack members are moved between said first and second positions.

3. A cabinet according to claim 2, wherein said top wall when in said first elevation is spaced downwardly a substantial distance from upper edges of the side walls, and is substantially flush with the upper edges of the side walls when in said second elevation;

said toothed rack being disposed at first and second elevations when said rack member is disposed respectively in said first and second positions; and said first location on said door being disposed vertically upwardly from said second location when said door is in said closed position.

4. A cabinet according to claim 3, wherein said securing means includes securing parts on said rack members, said securing parts being vertically displaced between two elevations when the rack member is vertically rotated 180° relative to the side wall, said top wall being fixedly but releasably connected directly to the securing parts of said rack members so that determination as to the first and second elevations of the top wall is automatically determined depending upon the selection of the first and second positions of the rack members.

5. A cabinet according to claim 4, wherein the cooperating means includes a pair of horizontal and generally parallel slots which are formed in the door in the vicinity of the upper edge thereof, said slots being vertically spaced apart when the door is in the closed position to define said first and second locations, said slots projecting horizontally widthwise of the door so as to project through opposite side edges thereof and also opening inwardly of the door, said mounting means including a bearing member fixed to each side edge of the door and having a bearing portion which projects into an adjacent end of each said slot, a horizontally elongated shaft disposed within a selected one of said slots and projecting horizontally and being rotatably supported within the bearing portions disposed adjacent the ends of the selected slot, said shaft projecting outwardly through the bearing portions and having shaft end portions on which the gears are nonrotatably secured, said shaft being disposed in the uppermost said slot when the top wall is in said first elevation and the toothed rack is in said first position, and said shaft being disposed in the lowermost said slot when the top wall is in said second elevation and the toothed rack is in said second position.

6. A cabinet according to claim 1, wherein the cooperating means includes a pair of horizontal and generally parallel slots which are formed in the door in the vicinity of the upper edge thereof, said slots being vertically spaced apart when the door is in the closed position to define said first and second locations, said slots projecting horizontally widthwise of the door so as to project through opposite side edges thereof and also opening inwardly through the inner surface of the door, said mounting means including a bearing member fixed to each side edge of the door and having a bearing portion which projects into an adjacent end of each said slot, a horizontally elongated shaft disposed within a selected one of said slots and projecting horizontally and being rotatably supported within the bearing portions disposed adjacent the ends of the selected slot, said shaft projecting outwardly through the bearing portions and having shaft end portions on which the gears are nonrotatably secured, said shaft being disposed in the uppermost said slot when the top wall is in said first elevation and the toothed rack is in said first position, and said shaft being disposed in the lowermost said slot when the top wall is in said second elevation and the toothed rack is in said second position.

7. A cabinet according to claim 6, wherein the rack member includes a vertically extending base wall which cooperates with the respective side wall to define a generally closed recess therebetween, said toothed rack being disposed within said closed recess, said base wall having a horizontally elongate guide slot formed therethrough in close proximity with and in parallel relationship to the elongated toothed rack, said shaft end portion projecting horizontally through the guide slot with the respective gear being positioned within the closed recess.

8. A cabinet according to claim 1, wherein the rack member includes a vertically extending base wall which cooperates with the respective side wall to define a generally closed recess therebetween, said toothed rack being disposed within said closed recess, said base wall having a horizontally elongate guide slot formed therethrough in close proximity with and in parallel relationship to the elongated toothed rack, said shaft end portion projecting horizontally through the guide slot with the respective gear being positioned within the closed recess.

9. A cabinet according to claim 8, wherein the side wall has a recess which opens inwardly from the inner side thereof in the vicinity of the upper edge thereof, said recess having a configuration for snugly accommodating the rack member therein so that the rack member is fixedly positioned relative to the respective side wall and the base wall of the rack member is substantially flush with the inner side of the respective side wall.

10. A cabinet according to claim 9, wherein each rack members is disposed in a first upright vertical orientation for securement to the respective side wall for defining said first position, and the rack members are vertically rotated 180° relative to the side walls from said first position so as to define said second position, said toothed rack being vertically oriented so as to face in opposite vertical directions when the rack member is moved between said first and second positions.

11. In a storage cabinet having a housing defined by generally parallel horizontally-extending top and bottom walls rigidly joined together by generally parallel vertically-extending side walls, the housing defining therein an interior storage compartment and having an opening in a front side thereof for access to said storage compartment, a door positionable adjacent the front side of the housing when in a closed position for closing off said access opening, and a support arrangement including a pair of gear/rack support mechanisms connected between said door and said side walls for permitting the door to be both swingably moved into an open position wherein the door extends generally horizontally in close proximity to the elevation of the top wall and linearly into a storage position wherein the door and top wall are positioned closely adjacent and substantially directly over one another, the improvement in said support arrangement comprising:

a horizontally elongate rack member fixedly but releasably secured to the respective said side wall adjacent an inner side thereof and in the vicinity of an upper edge thereof, said rack member defining thereon a horizontally elongated toothed rack which extends in the front-to-back direction of the cabinet;

said rack member and said side wall having cooperating means which permit the rack member to be fixedly but releasably mounted on the respective side wall in either a first position wherein the toothed rack faces upwardly or in a second position wherein the toothed rack faces downwardly, said rack member being vertically rotated 180° relative to the side wall to permit selection of said first and second positions;

a gear disposed for meshing and rolling engagement with the toothed rack associated with each said rack member;

mounting means associated with said door in the vicinity of each upper corner thereof for rotatably mounting a said gear thereon so that a pair of said gears are rotatably mounted on said door for rotation about a generally horizontal axis which extends lengthwise of the door in the vicinity of the upper edge thereof with the gears being positioned adjacent opposite side edges of the door; and securing means cooperating directly between said top wall and said rack members for fixedly but releasably securing said top wall directly to said rack members so that said top wall is disposed in first and second elevations which are vertically spaced a predetermined distance apart when said rack members are disposed in said first and second positions, respectively.

12. A cabinet according to claim 11, including cooperating means for mounting the gears and the rotational axis thereof on said door at either of first and second locations which are vertically spaced a predetermined vertical distance apart when the door is in said closed position, said gears being mounted in said first and second locations when said rack members are mounted in said first and second positions, respectively.

13. In a storage cabinet having a housing defined by generally parallel horizontally-extending top and bottom walls rigidly joined together by generally parallel vertically-extending side walls, the housing defining therein an interior storage compartment and having an opening in a front side thereof for access to said storage compartment, a door positionable adjacent the front side of the housing when in a closed position for closing off said access opening, and a support arrangement including a pair of gear/rack support mechanisms connected between said door and said side walls for permitting the door to be both swingably moved into an open position wherein the door extends generally horizontally in close proximity to the elevation of the top wall and linearly into a storage position wherein the door and top wall are positioned closely adjacent and substantially directly over one another, the improvement in said support arrangement comprising:

a horizontally elongate rack member fixedly but releasably secured to the respective said side wall adjacent an inner side thereof and in the vicinity of an upper edge thereof, said rack member defining thereon a horizontally elongated toothed rack which extends in the front-to-back direction of the cabinet;

said rack member and said side wall having cooperating means which permit the rack member to be fixedly but releasably mounted on the respective side wall in either a first position wherein the toothed rack faces upwardly or in a second position wherein the toothed rack faces downwardly, said rack member being vertically rotated 180° relative to the side wall to permit selection of said first and second positions;

a gear disposed for meshing and rolling engagement with the toothed rack associated with each said rack member;

mounting means associated with said door in the vicinity of each upper corner thereof for rotatably mounting a said gear thereon so that a pair of said gears are rotatably mounted on said door for rotation about a generally horizontal axis which extends lengthwise of the door in the vicinity of the upper edge thereof with the gears being positioned adjacent opposite side edges of the door; and cooperating means for mounting the gears and the rotational axis thereof on said door at either of first and second locations which are vertically spaced a predetermined vertical distance apart when the door is in said closed position, said gears being mounted in said first and second locations when said rack members are mounted in said first and second positions, respectively.

* * * * *